United States Patent [19]

Bühler

[11] 4,105,066

[45] Aug. 8, 1978

[54] HEAT EXCHANGER

[75] Inventor: Gerhard Bühler, Rheinfelden, Fed. Rep. of Germany

[73] Assignee: FRYMA-Maschinen AG, Rheinfelden, Switzerland

[21] Appl. No.: 738,109

[22] Filed: Nov. 2, 1976

[30] Foreign Application Priority Data

Nov. 5, 1975 [DE] Fed. Rep. of Germany ..... 2549600

[51] Int. Cl.[2] ..... F28F 17/00; F28G 3/10

[52] U.S. Cl. ..... 165/94; 366/309

[58] Field of Search ..... 259/DIG. 9, DIG. 10, 259/DIG. 18, 9, 10; 165/94; 34/185, 173, 178, 179; 62/342

[56] References Cited

U.S. PATENT DOCUMENTS

| | | | |
|---|---|---|---|
| 1,420,210 | 6/1922 | Paulus | 165/94 |
| 3,206,287 | 9/1965 | Crawford | 165/94 X |
| 3,476,522 | 11/1969 | Stovall | 165/94 X |

*Primary Examiner*—Charles J. Myhre
*Assistant Examiner*—Theophil W. Streule, Jr.
*Attorney, Agent, or Firm*—Max Fogiel

[57] ABSTRACT

A heat exchanger with a scraping cooling arrangement for fluid matter which tends to adhere to the heat exchanging surface. A pot-shaped casing is sealed by an end-plate. The casing provides for concentric interchanging of heat-exchanging parts with heat-exchanging agent flowing therethrough. At least three annular chambers are provided for processed matter to pass through. A power-driven stripping device consisting of stripping branches protruding axially and unsupported into the annular chambers with scraper bands fitting closely to the heat-exchanging surfaces, is rotatable about the axis of the casing. At least one annular chamber is, at one end, connected to the nearest outer annular chamber and is connected at the other end, to the nearest inner chamber in a circuit. The annular chambers are separated, however, in other respects, and at least one seal is formed by a gasket rotating with the stripping device. The gasket is located in a disc-shaped base chamber of the pot-shaped casing, between the bottom of the casing and a heat exchanger part of an inset.

8 Claims, 3 Drawing Figures

HEAT EXCHANGER

BACKGROUND OF THE INVENTION

The invention concerns a heat exchanger, in particular a scraping cooling apparatus for fluid matter which tends to adhere to the heat exchanging surface. The apparatus has a pot-like casing, sealed by an end-plate, and has concentrically interchanging heat-exchanging parts with heat-exchanging agent flowing through. At least three annular chambers are provided for processed matter to pass through, and a power-driven stripping device, consisting of stripping branches that protrude axially and unsupported into the annular chambers for matter with scraper bands fitting closely to the heat-exchanging surfaces, is arranged so as to rotate around the axis of the casing.

For the efficiency of heat-exchangers it is of vital importance that the value of heat transfer at the heat-exchanging surfaces should not or at least not significantly change during operation. Of course, one can select the heat-exchanging agent, the cooling or heating agents and the material for the heat-transfer partitions, the surfaces of which can be modelled accordingly, in such a way that this stipulation is largely accomplished on one side of the partition wall. On the side of the fluid matter this possibility, however, only limited. Firstly, the construction engineer does not definitely know which matter will be put through eventually, and secondly, it is not possible, with all the technical devices available, to prevent the adherence of diverse agents on the heat-exchanging surface. For example, many of the materials are used to change their viscosity when cooling, and the thickening material adheres more easily to the heat-exchanging surface forming an insulating layer which reduces the amount of heat transfer and the resulting degree of efficiency. Other materials precipitate during the heating process. In order to remedy this, scraping devices have been developed which constantly and automatically scrape the heat-exchanging surface on the side conducting the fluid matter.

A scraping cooling apparatus with an elongated tubular double-shell casing through which the heat-exchanging agent flows and along whose inner surface the treated matter is conducted, is known in the art. In this inner chamber there is in the axis of the casing, a shaft that is continually driven during the cooling operation and carries several scraping elements which scrape off the matter adhering to the inner heat-exchanging surface, so that the amount of heat transfer remains largely unchanged.

This construction, however, has a number of disadvantages. The loss of heat is comparatively great due to the fact that the outer surface of the double-shell body is larger than the inner heat-exchanging surface. This tubular model results in a cumbersome construction requiring too much space. Also cleaning is difficult, time-wasting and can often not be sufficiently accomplished.

The loss of heat is lower than in any other existing heat-exchanger, where three additional cylindrical heat-exchanging elements have been provided concentrically within a cooling jacket. Thereby the matter to be treated flows within the body from the chamber, at one face, to the other one on parallel paths between neighboring heat-exchanging parts. As a result, the whole heat-exchanging circuit is relatively short and this lessens the degree of efficiency. Moreover, the matter in the parallel connection strives towards the least resistance, and will therefore flow primarily in the inner annular chamber. The matter, therefore, will be cooled diversely, and the different currents must merge once again before a uniform quality can be achieved.

Accordingly, it is an object of the present invention to improve the degree of efficiency of the conventional heat exchanger.

Another object of the present invention is to provide a heat exchanger of the foregoing character which is simple in construction and may be economically fabricated.

A further object of the present invention is to provide a heat exchanger, as described, which may be readily maintained in service, and has a substantially long operating life.

SUMMARY OF THE INVENTION

The objects of the present invention are achieved by providing that at least one annular chamber for matter to be treated is connected at one end to the nearest outer chamber and at the other end to the nearest inner chamber in a circuit; in other respects, however, the annular chambers are separated whereby at least one seal is formed by a gasket rotating with the stripper.

Thus, the matter to be treated is conducted through at least three consecutively adjoining annular chambers for matter which have to be connected to or, sealed off, respectively, from one another at specific ends. Whereas sealing as well as transition at the end opposite the stripper can be achieved without difficulty, a separate gasket is provided on the side of the stripper both rotating together. As each particle of the matter is moved along all heat-exchanging surfaces, an unusually regular and intense heat-transfer is assured.

The gasket can be installed in a disc-shaped chamber at the bottom of the pot-shaped casing between the bottom of the casing and a heat-exchanger part of an insert. It is then, after removal of the insert, freely accessible, just like the stripper, and can easily be cleaned together with the stripper.

Radially arranged scraping elements for the faces of casing bottom and the neighboring end of the insert can be provided for at the stripper carrying the gasket. In addition, to the cylindrical surfaces of the heat-carrying parts, the radial faces will be scraped, whereby the heat transfer is improved just as it is by the fact that the bottom of the casing is constructed as a hollow form and the heat-exchanging agent is flowing.

The inlet of matter to be treated can be applied outside at flanged plates of the casing and the outlet within the gasket at the bottom of the casing. If three chambers for matter are available, the matter is then able to flow in two chambers in anti-flow to the heat-exchanging agent.

To admit and discharge the heat-exchanging agent, one can apply connecting pipes, which are conducted in the inner parts of the heat-exchanger parallel to the axis of the casing up to the open end of the inset where they are bent in the direction of circumference. In this way, the heat-exchanging agent can be sent spirally along the heat transfer surfaces in counter-flow on a longer path and with a faster flow of current, which in turn, increases the amount of heat transfer.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWINGS

FIG. 3 is a partial sectional view and shows a gasket used in a portion of FIG. 1.

DESCRIPTION OF THE PREFERRED EMBODIMENTS

Figure 1:
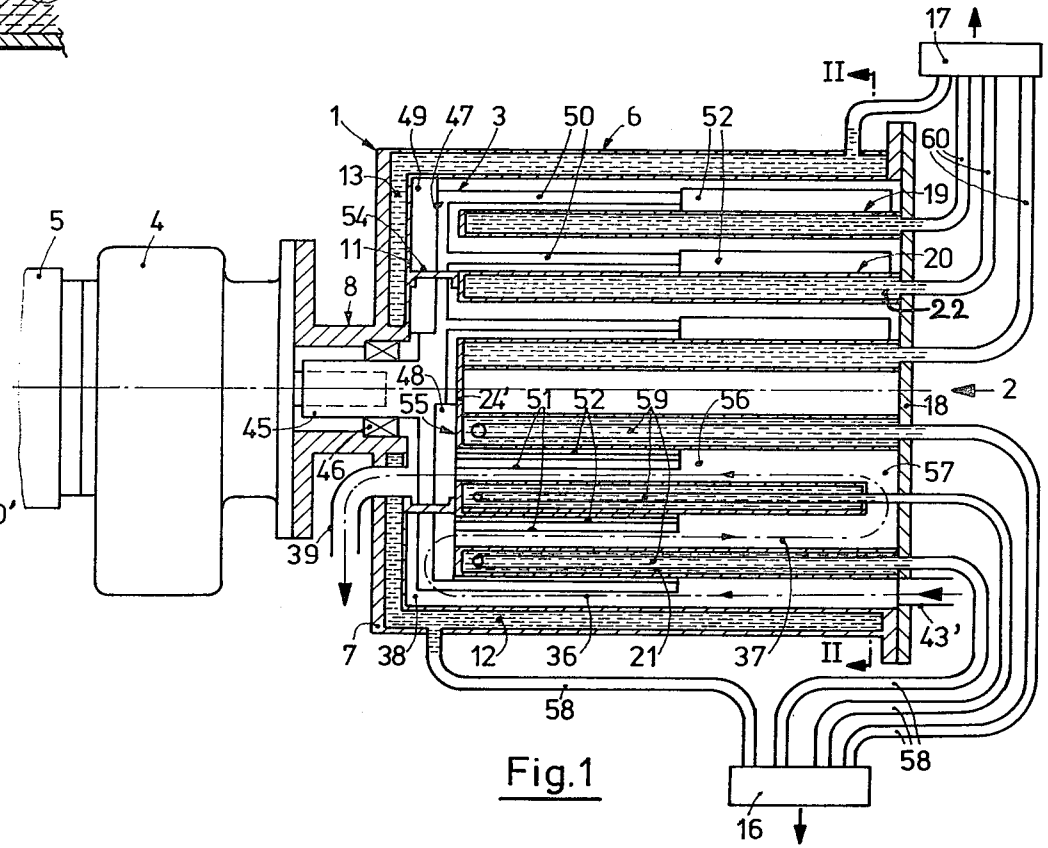
FIG. 1 is a diagrammatical longitudinal section through a heat-exchanger in accordance with the present invention.

Referring to the drawing, in the pot-shaped double-shell casing 1 there is provided a removable insert 2. A stripper 3 can be brought into rotation via a mechanism 4 by an electromotor 5.

The double-shell casing 1 consists of an outer cylindrical drum 6, a casing bottom 7 and a hub part 8, to which the mechanism 4 is flanged and which is constructed as a casting together with the bottom of the casing. The latter is not represented on the diagram. Onto the bottom 7 of the casing, the drum 6, which is constructed in one piece with an inner bottom plate, is flanged - not shown in detail here. The drum encircles an outer cylindrical chamber for the cooling agent 12 and a disc-shaped cooling agent chamber 13 in the bottom 7. Both connecting chambers are accessible for cleaning by the removal of the drum 6.

At the free end of the double-shell casing 1, the inset 2 is mounted by means of a flange plate 18. It features two heat-exchanging double-shell parts 19 and 20 which are fixed concentrically to the drum 6. These parts in turn are detachably joined in the flange plate 18 and bind the cylindrical cooling agent chambers 21 and 22. In the inner compartment of the double-shell part 20, there is an annular pot 55 for cooling agents. The latter is connected to the open end of the insert by the frontal plate 24. In this way another annular chamber 56 for matter to be treated is created. For better cleaning purposes of the chambers for the matter, the double-shell part 20 at least must be fixed to the flange plate 18 so as to be removable.

Between the pot-shaped double-shell body 1, the inset 2 and the port for the cooling agent 55, three concentric annular chambers 36, 37 and 56 are thus formed and are linked consecutively. For this purpose, a gasekt 54 fixed to the spokes of the stripper is fitted between the bottom 7 of the casing and the open end of the inset 2. Here the matter flow from the inlet 43 through the annular chamber 36 and to the bottom chamber 38. From there it flows through the central annular chamber 37 to the flange plate 18. From here it is introduced by openings 57 in the double-shell part 20 into the inner annular chamber 56, and reaches through the latter out of the inner part of the bottom chamber 38, the outlet 39. The inlet as well as the outlet of the matter can be shaped by the deflection in such a manner, that a spiral movement of the matter is achieved at the concentric cylindrical heat-exchanging surfaces. All heat-exchaning surfaces can be exposed for cleaning by simply removing the inset. Shoule an even better accessibility to the heat-exchanging surfaces in the annular chambers for matter 37 and 56 be desired, one can remove the double-shell part 20 from the flange plate 18.

The stripper 3 is with its hub 45, wedged onto the power-take-off shaft of the power driven mechanism 4. A washer 46 fitted between this hub and the hub part 8, seals off the chambers from the mechanism. From the hub in the bottom chamber 38 spokes 47 protrude radially to the outside, on which are mounted scraping band 48, 49 for the frontal plate of the insert and the bottom surface of the bottom of the casing 7 or the bottom wall 1, respectively.

Fixed to the spokes 47, arranged in a 90° division, are longer stripper branches 50 as well as shorter ones 51. These protrude axially in opposite pairs into the annular chamber, and carry according to FIG. 1, longitudinally directed and staggered scraping bands 52 for the inner heat-exchanging surfaces; these scraping bands extend over half the length of the heat-exchanging surfaces. Scraping bands 53 for the outside heat-exchanging surfaces are fixed to the stripper branches 50 so that they are arranged at an angle of 90° to the bands 52. The adjustment of these scraping bands is wedge-shaped at angles between some 35° and 50° forward with regard to the direction of rotation. They are formed elastically to the effect that by action of elastic power, they scrape all eliminated parts of the processed material off the heat-exchanging surface and in addition, direct the matter immediately towards the opposite heat-exchanging surface as illustrated by the arrangement of circular arrows in FIG. 2. The scraper bands are screwed onto the stripper branches through slot holes and are thus adjustable. The force of pressure, thereby, can be regulated smoothly and continuously conforming to the needs of the product.

Figure 2:
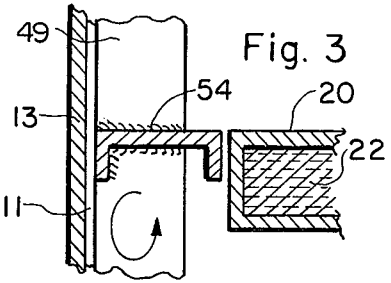
FIG. 2 is a section taken along line II—II of FIG. 1.
Figure 2:
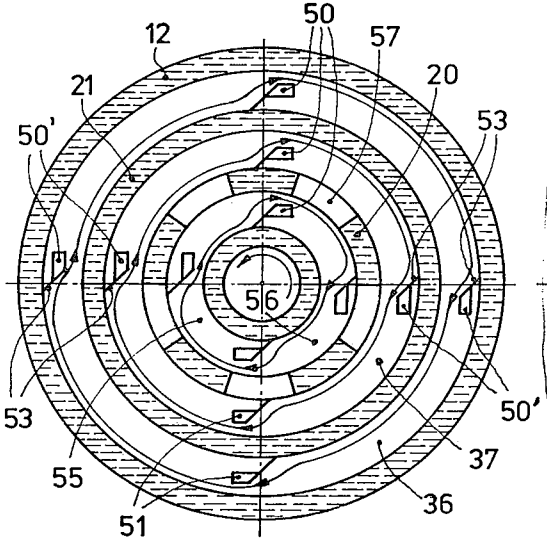

Moving from the inlet for cooling agents through tubes 58 and inlet pipes 59, the agent reaches the end of the annular chambers for cooling agents as on the left hand of FIG. 1. After tangential introduction it is discharged there at the end on the right (not shown on the diagram), and conducted through tubes 60 to the outlet for cooling agents 17.

The chambers for cooling agents are separated here by altogether eight cylindrical heat-transfer surfaces, six of which are utilized for heat transfer. This means, that only the external cylindrical surface requires insulation. The loss of heat is therefore considerably reduced.

The same arrangement can always be applied without alterations, if instead of a cooling agent a heating agent is conducted through, i.e., if the matter is to be heated. If several units are in operation, some of which are run with cooling, and some with heating agents, one can largely do without the external addition or dispersion of heat. If necessary, the units can be run in a complete cycle.

Without further analysis, the foregoing will so fully reveal the gist of the present invention that others can, by applying curent knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A heat exchanger, in particular a scraping cooling arrangement for fluid matter tending to adhere to the heat-exchanging surface comprising: a pot-shaped casing; and endplate sealing said casing, said casing concentrically interchanging heat-exchanging parts with heat-exchanging agent flowing therethrough; at least three annular chambers for process matter to pass through; a power-driven stripping device having spaced stripping branches protruding axially and unsupported into said annular chambers and having scraper branches fixed and justaposed to the heat exchanger surfaces of said parts, said stripping device being rotatable about the axis of said casing, at least one annular chamber being at one end connected to a nearest outer annular chamber and being connected at the other end to a nearest inner chamber in a circuit, the annular chambers being separated, and a gasket rotating with said stripping device for forming at least one seal; insert means defined by a flanged plate for including cooling elements adapted to be loosely insertable at one end of said casing, said gasket sealing slidingly against said insert means and against the bottom of said casing, said annular chambers being arranged for process matter to flow from an inlet on said casing through one of said annular chambers and then to a bottom chamber in said casing, the process matter flowing from said bottom chamber through a second annular chamber and from said second annular chamber to a third annular chamber for exiting through an outlet of said bottom chamber.

2. A heat exchanger as defined in claim 1 wherein said pot-shaped casing has a disc-shaped base chamber, said gasket being fitted in said disc-shaped base chamber between the bottom of said casing and a heat exchanger part of said insert means.

3. A heat exchanger as defined in claim 2 wherein said stripping device has radially arranged scraping elements at the end of said insert means for scraping the face of the bottom portion of said casing and the face side of said insert means.

4. A heat exchanger as defined in claim 1 wherein the bottom of said casing has a hollow shape for the flow of heat-exchanging agent therethrough.

5. A heat exchanger as defined in claim 1 including flow inlet means arranged outside on a flange disc of said casing; and flow outlet means arranged within said gasket at the bottom of said casing.

6. A heat exchanger as defined in claim 1 wherein said three chambers are interconnected so that the flow of matter to be processed in two of said chambers is connected counter to the flow of heat-exchanging agent.

7. A heat exchanger as defined in claim 6 including inner heat-exchanger parts parallel to the axis of said casing; and connecting tubes in said inner heat-exchanger parts and extending to the open end of said insert means, said connecting tubes being bent at said insert means in the direction of the circumference of said insert means.

8. A heat exchanger as defined in claim 1 including a disc-shaped base chamber in said pot-shaped casing, said gasket being fitted in said disc-shaped base chamber between the bottom of said casing and a heat exchanger pot of said insert means; said stripping device having radially arranged scraping elements at the end of said insert means for scraping the face of the bottom portion of said casing; the bottom of said casing having a hollow shape for the flow of heat exchanging agent therethrough; said inlet means being arranged outside on a flange disc of said casing; said outlet means being arranged within said gasket at the bottom of said casing; said three chambers being interconnected so that the flow of matter to be processed in two offset chambers is connected counter to the flow of heat-exchanging agent; inner heat-exchanger parts parallel to the axis of said casing; connecting tubes in said inner heat-exchanger parts and extending to the open end of said insert means, said connecting tubes being bent at said insert means in the direction of the circumference of said insert means; a flange plate at one end of said casing for mounting said insert means and having two heat-exchanging double-shell parts, said three annular chambers concentric and linked consecutively, matter to be processed flowing from said bottom chamber to a central one of said annular chambers and onto said flange plate, the flow from said flange plate being directed by openings in one of said double-shell parts into an inner one of said annular chambers, substantially all heat-exchanging surfaces being exposed for cleaning by removal of said insert means, said stripper branches having longer branches and shorter branches protruding axially in opposite pairs into the annular chamber and carrying longitudinally directed and staggered scraping bands extending over half the length of the heat-exchanging surfaces.

* * * * *